United States Patent [19]

Grant

[11] Patent Number: 4,544,903

[45] Date of Patent: Oct. 1, 1985

[54] ELECTRICAL CONNECTOR SYSTEM

[75] Inventor: John T. Grant, Guestwick, England

[73] Assignee: Pittway Corporation, Syosset, N.Y.

[21] Appl. No.: 552,982

[22] Filed: Nov. 17, 1983

[51] Int. Cl.[4] ..... H01H 9/00

[52] U.S. Cl. ..... 335/205; 335/207

[58] Field of Search ..... 335/205, 206, 207

[56] References Cited

U.S. PATENT DOCUMENTS

| | | | |
|---|---|---|---|
| 2,912,540 | 11/1959 | Sawicki | 200/87 |
| 3,376,527 | 4/1968 | Risk | 335/207 |
| 3,470,554 | 9/1969 | Corbell | 340/274 |
| 3,569,645 | 3/1971 | Lea | 335/205 X |
| 3,641,540 | 2/1972 | Cutler et al. | 340/224 |
| 3,771,153 | 11/1973 | Byrne | 340/274 |
| 3,771,154 | 11/1973 | Takei | 340/275 |
| 3,801,767 | 4/1974 | Marks | 335/205 X |
| 3,810,258 | 5/1974 | Mathauser | 339/12 R |
| 3,852,692 | 12/1974 | Moorman | 335/205 |
| 3,859,612 | 1/1975 | Kashio | 335/205 |
| 3,966,289 | 6/1976 | Schlage | 339/4 |
| 3,986,183 | 10/1976 | Fujiwara | 340/276 |
| 4,241,337 | 12/1980 | Prada | 340/547 |
| 4,317,969 | 3/1982 | Riegler et al. | 200/52 R |
| 4,339,640 | 7/1982 | Grant | 200/61.45 R |
| 4,359,646 | 11/1982 | Mejia et al. | 307/116 |

FOREIGN PATENT DOCUMENTS

| | | | |
|---|---|---|---|
| 65989 | 7/1982 | Japan | 335/205 |

*Primary Examiner*—George Harris

[57] ABSTRACT

An electrical connector system includes two cooperating connector components, each of which includes a housing of electrically insulating material and a support body mounted for movement within the housing. Each support body carries a contact member and a magnet member, and biasing means retracts the support body into the housing. When the two connector components are in juxtaposed relation, magnetic forces produced by the aligned magnet members interact to draw the support bodies out of their housings and place the contact members in engagement to complete electrical circuits therebetween, the circuits being maintained by the magnetic forces and released when the support members are moved to an offset position. The magnets provide a constant closing force on the contact members when the magnets are aligned, irrespective of the positions or relative movement of the closure surfaces that they are monitoring. Thus, windows and doors that have loose fittings or may move while in the "secure" position are unlikely to cause intermittent circuit interruption of the monitoring connector system. When the window or door is opened, either by direct pull or by sliding action, the magnetic elements assist the support bodies to snap apart and the contact surfaces retract into their housings where they are less vulnerable to damage.

18 Claims, 9 Drawing Figures

FIG 1
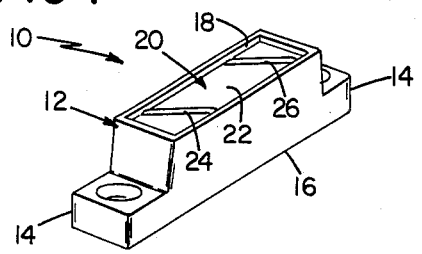
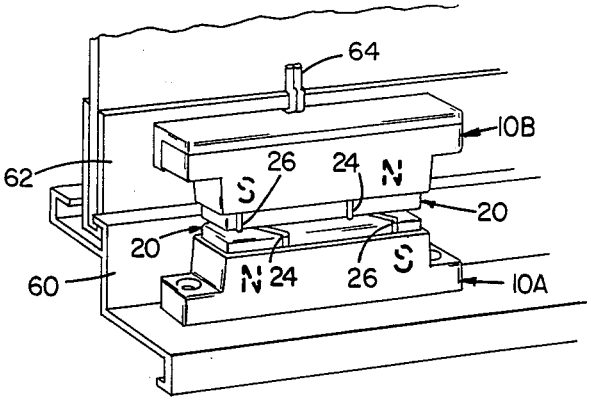
FIG 5
FIG 3
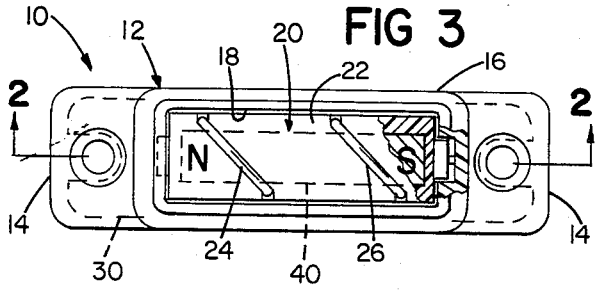
FIG 2
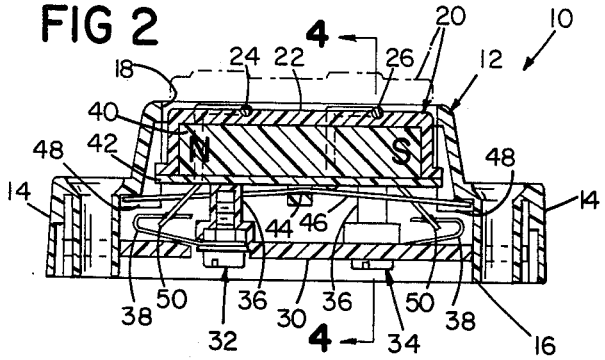
FIG 4
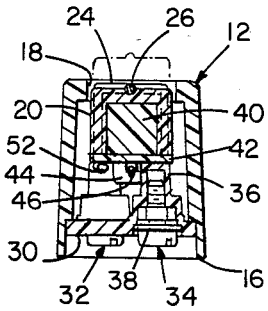
FIG 6
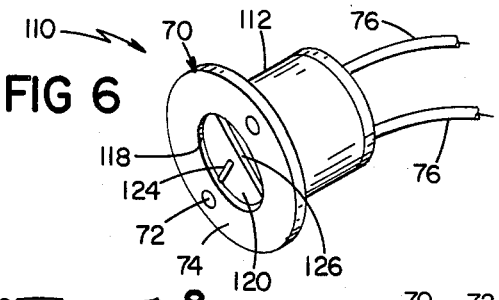
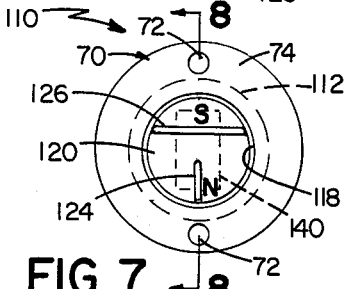
FIG 7
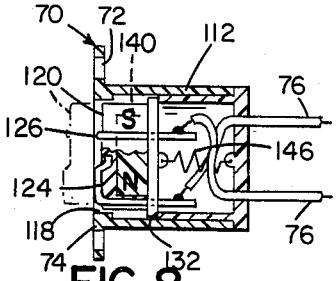
FIG 8
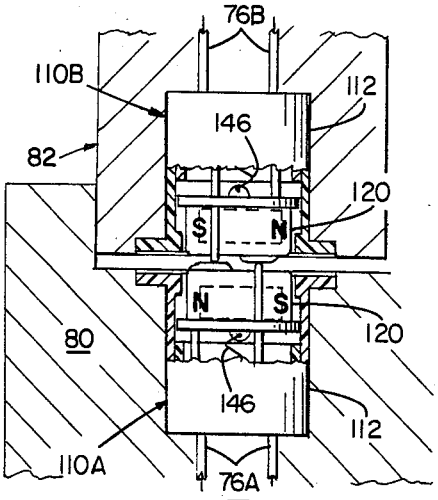
FIG 9

ELECTRICAL CONNECTOR SYSTEM

This invention relates to electrical connector systems, and more particularly to electrical connector systems of the type suitable for use in the security industry for making connection to sensors or conductors that are attached to surfaces of an opening to be monitored, such as a window or door, that is movable between an open (non-secure) position and a closed (secure) position, the connector system completing an electrical circuit when the structure to which it is attached is in the closed (secure) position.

Most such prior connector systems employ two components that are mounted for movement in a direction that is perpendicular to their contact surfaces. There are application requirements such as sliding window or sliding door applications where it is desirable to mount the connector system components in transverse or sliding relation rather than in opposed (perpendicular movement) relation.

In accordance with the invention there is provided an electrical connector system that includes cooperating connector components, each of which includes a housing of electrically insulating material and a support body mounted for movement within the housing. Each support body carries a contact member and a magnet member, and biasing means retracts the support body into the housing. When two such connector components are in proper juxtaposed relation, magnetic forces produced by the aligned magnet members interact to draw the support bodies out of their housings and place the contact members in engagement to complete electrical circuits therebetween, the circuits being maintained by the magnetic forces and released when the support members are moved to an offset position.

In preferred embodiments, each contact member is a solid metal wire member of circular cross section that is connected to a terminal and two wires are disposed in side-by-side spaced relation adjacent a bar magnet embedded in the support body. When the "north" and "south" poles of the embedded bar magnets are aligned in opposite polarity relation, the resulting magnetic forces attract the support bodies towards one another and the wires form crossbar or cross-point type connections between the two components. As one of the two components is slid linearly away from the other to an offset position, the magnets generate repelling forces which assist the biasing members in retracting the members into the housings, thereby providing clearance for the sliding or shifting movement of the connector components. The magnets provide a constant closing force on the contact members when the magnets are aligned, irrespective of the positions or relative movement of the closure surfaces that they are monitoring. Thus, windows and doors that have loose fittings or may move while in the "secure" position are unlikely to cause intermittent circuit interruption of the monitoring connector system. In addition, the crossbar or cross-point type connections insure high contact integrity and accommodates a relatively large movement between the two components in any direction, the X Y movement being that accommodated by the relatively long length of the contacts and the Z movement being that accommodated by the free travel of the magnetically moved support members. In each connector component, floating contact wires may be connected to fixed terminals in the housing. Under normal closure monitoring conditions, the magnets attract each other and hold the contacts together under constant pressure and when the window or door is opened, either by direct pull or by sliding action, the magnetic elements allow the support bodies to snap apart and retract into their housings such that the contact surfaces are less vulnerable to damage. Thus, closely fitting connector assemblies may be arranged without interference due to sliding or similar relative movement between the components of the monitored opening structure.

Other features and advantages of the invention will be seen as the following description of particular embodiments progresses, in conjuction with the drawings, in which:

FIG. 1 is a perspective view of a connector component in accordance with the invention;

FIG. 2 is a sectional view taken along the line 2—2 of FIG. 3;

FIG. 3 is a top view (with parts broken away) of the connector unit shown in FIG. 1;

FIG. 4 is a sectional view taken along the line 4—4 of FIG. 2;

FIG. 5 is a perspective view of two connector components in a typical installation showing their wire contacts attracted to each other and completing an electrical circuit;

FIG. 6 is a perspective view of a second embodiment of a connector unit in accordance with the invention;

FIG. 7 is a front view of the connector unit shown in FIG. 6;

FIG. 8 is a sectional view taken along the line 8—8 of FIG. 7; and

FIG. 9 is a sectional view showing a installation of two contact units of the type shown in FIG. 6.

DESCRIPTION OF PARTICULAR EMBODIMENTS

The connector unit 10 shown in FIG. 1 includes a housing 12 of electrically insulating material that has mounting tabs 14 at either end of body portion 16 in which an upwardly open aperture 18 is defined. Housing 12 has an overall length of about 2½ inches, a height of about one inch, and a width of about ¾ inch. Mounted within opening 18 of housing body 16 is magnet case 20 that has a width of about ½ inch and a length of about 1¼ inches. Pressed into recesses on the upper face 22 of magnet case 20 are nickel-plated phosphor-bronze contact wires 24, 26, each about ¾ millimeter in diameter. Further details of connector unit 10 may be seen with reference to FIGS. 2–4.

As shown in those figures, terminal support member 30 is fixed in the base of housing 12 and carries two screw type terminal assemblies 32, 34 that are received in upwardly extending post portions 36. A flexible brass connecting strip 38, attached to each terminal assembly 32, 34, extends diagonally upwardly through support member 30 and has a bight with the free end of each strip 38 soldered to a corresponding contact wire 24, 26. Seated on the tops of posts 36 of member 30 is magnet case 20 which houses bar magnet 40 that has "N" and "S" poles as indicated. Case 20 is closed at its lower side by sheet member 42 that has integral loop 44 through which 0.3 millimeter diameter piano wire spring 46 extends. The ends of spring wire 46 are seated in recesses 48 at either end of housing body portion 16 such that spring 46 retracts magnet case 20 into the housing 12 and seats that case on the tops of posts 32, but allows outward movement of case 20 to the dotted line position indicated in FIGS. 2 and 4.

Each contact wire 24, 26 has an end 50 soldered adjacent the end of a corresponding connector strip 38 and extends from end 50 upwardly in a groove in the sidewall of magnet case 20, along a 45° angle groove in the top wall of case 20, and downwardly in a groove on the opposite sidewall of case 20 with its tip 52 extending through sheet 42 and being bent over to secure the contact wire in position.

Two connector units 10A, 10B may be mounted on frame 60 and window 62 respectively of a sliding window installation as shown in FIG. 5, for example. In such installation, in closed position, the two housing openings 18 are in alignment, the "N" and "S" poles of the two bar magnets 40 are oppositely positioned, and the contact wires 24, 26 of the two units are disposed so that they cross at right angles. Each spring wire 46 normally retracts its magnet case 40 into housing 12 to the full line position indicated in FIG. 3, but when the two connector units 10 are in aligned position as indicated in FIG. 5, the two bar magnets 40 are magnetically attracted towards one another, moving the cross-bar contact wires 24, 26 of the units 10A, 10B into engagement and completing an electrical circuit between wires 64 connected to the terminals 32, 34 of the window connector unit 10B and similar wires connected to the connector unit 10A mounted on frame 60.

As window 62 is slid open, the magnetic poles of the two bar magnets 40 are moved into offset position, creating opposing magnetic force which supplements the retracting forces of springs 46, snapping the magnet cases 20 apart and opening the electrical circuit between the two connector units 10A, 10B. When the window 62 is open, the contact wires 24, 26 of each connector unit 10A, 10B are withdrawn into housing 12 in protected position, and when the window is closed (in the position shown in FIG. 5) the magnetic forces generated by the two aligned bar magnets move the magnet cases towards one another and place the two sets of contact wires 24, 26 in firm cross-bar type engagement with a closing force that maintains circuit integrity while accommodating a limited range of movement ("window rattle") in the window closed position.

The connector unit embodiment shown in FIG. 7 is designed for flush mounting in the frame of a door or window, for example. Unit 110 includes housing 112 of electrically insulating material that has flange 70 with apertures 72 for suitable fasteners. Disposed in opening 118 in the face 74 of flange 70 is magnet case 120 which carries wire contacts 124, 126 that are disposed at right angles to one another. Fly lead conductors 76 that extend from the rear of housing 112 are soldered to the ends of contact wires 124, 126 as indicated in FIG. 8.

As indicated in FIG. 8, bar magnet 140 is housed in magnet case 120, and biasing spring 146 extends between case 120 and housing 112 such that magnet case 120 is retracted into housing 112 with its flange seated on locating stop surface 132 such that the surfaces of contact wires 124, 126 are below the surface of flange 74.

An installation of contact units 110A, 110B is shown in FIG. 9, contact unit 110A being mounted in door frame 80 and contact unit 110B being mounted in door 82. The two contact units 110A, 110B are oriented such that the poles of the bar magnets 140 are in opposite relation and, when door 82 is closed as shown in FIG. 9, the resulting magnetic forces overcome the retracting forces of biasing springs 146 and draw the magnet cases 120 out of their housings towards one another and place the contact wire 126 of each unit in firm engagement with the contact wire 124 of the opposed unit, completing electrical circuits between fly leads 76A of unit 110A and fly leads 76B of unit 110B with cross-point type engagement.

While particular embodiments of the invention have been shown and described, various modifications will be apparent to those skilled in the art, and therefore it is not intended that the invention be limited to the disclosed embodiments or to details thereof, and departures may be made therefrom within the spirit and scope of the invention.

What is claimed is:

1. A security system contact assembly for building openings such as doors, windows and the like comprising a housing of electrically insulating material, said housing having an opening and support structure for securing said housing to a structural member, a magnet case disposed within said housing, said magnet case having a planar surface, two electrically conductive contact members disposed in electrically spaced relation on said planar surface of said magnet case, biasing means for retracting said magnet case into said housing so that the surfaces of said contact members are, below the surface of said opening, and terminal means in said housing connected to said contact members for connection to remote circuitry.

2. The connector assembly of claim 1 wherein each said contact member is a wire of circular cross section in the order of about one millimeter in diameter.

3. The connector assembly of claim 1 wherein each said contact member is a solid metal wire member of circular cross section that is connected to a terminal and the two wires are disposed in spaced relation and a bar magnet is in said magnet case.

4. The connector assembly of claim 3 wherein said wires are disposed generally parallel to one another.

5. The connector assembly of claim 4 wherein said wires are disposed generally perpendicular to one another.

6. The connector assembly of claim 1 and further including a resilient coupling between said contact member and said terminal means.

7. A security contact system for door openings and the like including two connector assemblies, each said connector assembly comprising a housing of electrically insulating material, said housing defining an aperture and having structure for attaching said housing to a structural member of the opening to be monitored, a contact block disposed within said housing, a magnet and an electrically conductive contact member carried by said contact block, biasing means for retracting said contact block into said housing so that the surface of said contact member is below the surface of said aperture, and terminal means in said housing connected to said contact member for connection to remote circuitry, one of said connector assemblies being adapted for mounting on a fixed part of the opening structure to be monitored and the other assembly being adapted for mounting on a movable portion of said opening structure so as to be adjacent said one connector assembly when said opening structure is in a closed position, said contact blocks being movable under the influence of magnetic field when the movable portion of said opening structure is in closed position such that said contact members move outwardly from said housing towards one another under the influence of magnetic force provided by said magnets and in opposition to the biasing force of said biasing means to complete an electrical circuit between said terminal means.

8. The system of claim 7 wherein each said magnet is an elongated bar magnet that has spaced 'north' and 'south' poles.

9. The system of claim 7 wherein each said contact block has a planar surface and each said contact member is a wire that extends along said planar surface, said contact wires making circuit connections of the crossbar or cross-point type.

10. The system of claim 7 wherein each said connector assembly includes two of said contact members that are disposed in electrically spaced relation on the surface of said contact block and further including a resilient coupling between each said contact member and said terminal means.

11. The system of claim 10 wherein each said contact block has a planar surface, each said contact member is a wire that extends along said planar surface, and said contact wires make circuit connections of the crossbar or cross-point type.

12. The system of claim 7 wherein each said contact member is a solid metal wire member of circular cross section that is connected to a terminal, two wires are disposed in spaced relation on a planar surface of each said contact block, and a bar magnet is in each said contact block.

13. The system of claim 12 wherein said wires are disposed generally parallel to one another.

14. The system of claim 12 wherein said wires are disposed generally perpendicular to one another.

15. For use in a security system for monitoring door openings and the like, a connector assembly adapted for mounting on a fixed part of the door opening for positioning adjacent a cooperating connector assembly mounted on a movable portion of said opening so as to be adjacent one another when said opening is in a closed position, said connector assembly including a housing of electrically insulating material, said housing having a face and an aperture in said face, a contact assembly mounted within said housing adjacent said opening, said contact assembly comprising two contact members having projecting surfaces, means connecting said contact members to corresponding terminal means, and a magnet member carried by said contact assembly, said magnet member having spaced north and south poles, and biasing means retracting said contact assembly into said housing so that said contact surfaces are beneath said face of the housing, said contact assembly being movable under the influence of magnetic force when the movable portion of said door opening is moved into closed position such that said contact assembly moves outwardly from said housing towards the cooperating connector assembly under the influence of the magnetic force and in opposition to the biasing force to complete an electrical circuit between said terminals and said cooperating connector assembly.

16. The connector assembly of claim 15 wherein said contact members are wires of circular cross section in the order of about one millimeter in diameter.

17. The connector assembly of claim 16 wherein said contact assembly has a planar surface and each said contact wire extends along said planar surface, said contact wires making circuit connections of the crossbar or cross-point type with similar contact wires of the cooperating connector assembly.

18. The connector assembly of claim 17 and further including a resilient coupling between each said contact wire and a corresponding one of said terminal means.

* * * * *